US008132800B2

(12) United States Patent
Tamai

(10) Patent No.: US 8,132,800 B2
(45) Date of Patent: Mar. 13, 2012

(54) CLAMP APPARATUS

(75) Inventor: Atsushi Tamai, Moriya (JP)

(73) Assignee: SMC Kabushiki Kaisha, Tokyo (JP)

( * ) Notice: Subject to any disclaimer, the term of this patent is extended or adjusted under 35 U.S.C. 154(b) by 442 days.

(21) Appl. No.: 12/524,588

(22) PCT Filed: Jan. 28, 2008

(86) PCT No.: PCT/JP2008/051701

§ 371 (c)(1),
(2), (4) Date: Jul. 27, 2009

(87) PCT Pub. No.: WO2008/099694

PCT Pub. Date: Aug. 21, 2008

(65) Prior Publication Data

US 2010/0044942 A1 Feb. 25, 2010

(30) Foreign Application Priority Data

Feb. 15, 2007 (JP) ..... 2007-035074

(51) Int. Cl.
*B25B 5/12* (2006.01)
*B23Q 3/08* (2006.01)

(52) U.S. Cl. ..... 269/32; 269/228; 269/24

(58) Field of Classification Search ..... 269/32, 269/228, 24, 201, 25, 27, 20, 35
See application file for complete search history.

(56) References Cited

U.S. PATENT DOCUMENTS

| | | | | |
|---|---|---|---|---|
| 5,823,519 | A | 10/1998 | Tunkers | |
| 6,378,856 | B1 | 4/2002 | Takahashi | |
| 6,416,045 | B1 * | 7/2002 | Morroney | 269/32 |
| 6,612,557 | B2 * | 9/2003 | Sawdon et al. | 269/32 |
| 6,814,349 | B2 * | 11/2004 | Migliori | 269/32 |
| 6,877,730 | B2 * | 4/2005 | Sawdon et al. | 269/32 |
| 6,880,816 | B1 * | 4/2005 | Wheeler et al. | 269/32 |
| 6,997,447 | B2 | 2/2006 | Fukui | |
| 2010/0044942 | A1 * | 2/2010 | Tamai | 269/32 |

FOREIGN PATENT DOCUMENTS

| | | |
|---|---|---|
| DE | 295 16 531 | 2/1996 |
| DE | 196 45 778 | 5/1998 |
| DE | 298 17 335 | 4/1999 |

(Continued)

OTHER PUBLICATIONS

Russian Decision to Grant Patent for Invention issued on Feb. 14, 2011 in corresponding Russian Application No. 2009129535/02 (041141) (with an English Translation).

(Continued)

*Primary Examiner* — Lee D Wilson

(74) *Attorney, Agent, or Firm* — Oblon, Spivak, McClelland, Maier & Neustadt, L.L.P.

(57) ABSTRACT

A lock mechanism includes a casing that is fixed to a side surface of a body, a handle disposed rotatably on the outside of the casing, and a transmission section, which is capable of transmitting a drive force applied by the handle. An end of a guide rod making up the transmission section is connected in a body surrounding groove of a piston rod disposed inside the body. In addition, by rotating the handle, the guide rod of the transmission section is displaced vertically (upward and downward), such that an arm is rotationally displaced through a toggle link mechanism by displacement of the piston rod along the axial direction.

8 Claims, 12 Drawing Sheets

FOREIGN PATENT DOCUMENTS

| | | | |
|---|---|---|---|
| DE | 20 2005 004 598 | | 8/2006 |
| EP | 1 060 839 | | 12/2000 |
| EP | 1 563 956 | | 8/2005 |
| EP | 1 702 720 | | 9/2006 |
| JP | 2004-90163 | A | 3/2004 |
| KR | 10-0570848 | | 4/2006 |
| SU | 1602668 | A1 | 10/1990 |

OTHER PUBLICATIONS

Office Action issued Jun. 2, 2011 in Korea Application No. 10-2009-7019145 (With Partial English translation).

* cited by examiner

CLAMP APPARATUS

TECHNICAL FIELD

The present invention relates to a clamp apparatus, which is capable of clamping a workpiece through a clamp arm rotated through a predetermined angle under a displacement action of a piston.

BACKGROUND ART

Heretofore, for example, when structural components of an automobile or the like are welded together, a clamp apparatus is used for clamping such structural components in place.

Such a clamp apparatus includes a main body and a clamp arm that is rotatable through a predetermined angle via a toggle link mechanism disposed inside the main body. Additionally, the clamp arm is rotated at the predetermined angle through the toggle link mechanism, which is connected to a rod arranged inside the main body, and by displacement of the rod along the axial direction, so that corresponding to the direction of rotation, the clamp arm is switched between a clamped state capable of clamping the workpiece and an unclamped state in which the clamped state of the workpiece is released.

For example, as disclosed in the specification of German Patent Publication No. DE 196 45 778 A1, an air-driven system is known, in which a piston disposed inside a main body is displaceable under the supply of a pressure fluid. Upon displacement of the piston, a clamp arm is rotated through a toggle link mechanism connected to a piston rod for switching between clamped and unclamped states of the workpiece. Also, a hand operated system is known, which comprises a handle that is operable by an operator and is capable of switching between clamped and unclamped states of the workpiece with the clamp arm by rotating the handle.

Incidentally, in the case that the aforementioned air-driven or manually driven clamp apparatus is used, respective clamp apparatuses are prepared separately depending on the use environment, for carrying out operations to clamp workpieces. However, in this case, an air-driven clamp apparatus and a manually driven clamp apparatus must be provided separately and respectively, such that the preparatory procedures therefore are complicated, together with concerns over increasing equipment costs.

DISCLOSURE OF INVENTION

A general object of the present invention is to provide a clamp apparatus that is capable of switching selectively between clamped and unclamped states of a workpiece, by means of either a pressure fluid or a manual operation.

The above and other objects features and advantages of the present invention will become more apparent from the following description when taken in conjunction with the accompanying drawings in which a preferred embodiment of the present invention is shown by way of illustrative example.

BEST MODE FOR CARRYING OUT THE INVENTION

Figure 1:
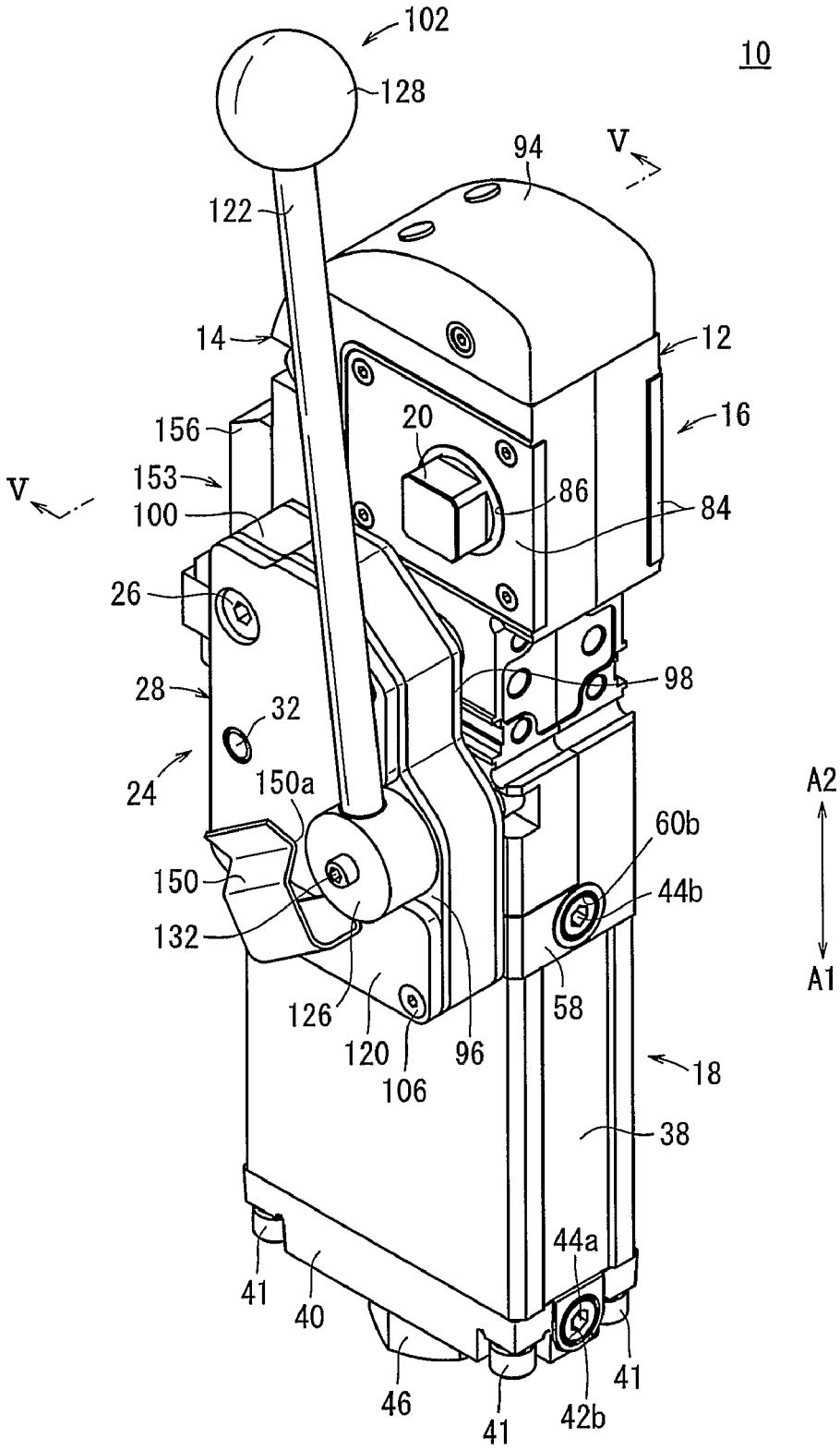
FIG. 1 is an exterior perspective view of a clamp apparatus according to an embodiment of the present invention.

In FIG. 1, reference numeral 10 indicates a clamp apparatus according to an embodiment of the present invention.

As shown in FIGS. 1 through 6, the clamp apparatus 10 comprises a body (main body) 16 formed in a flattened shape from first and second casings 12, 14, a cylinder section 18 connected to a lower end of the body 16, an arm (clamp arm) 22 connected to a rectangular axial bearing 20 that projects outwardly from the body 16, and a lock mechanism (switching mechanism) 24 disposed on a side of the body 16, which is capable of switching arbitrarily between clamped and unclamped states of a workpiece (not shown) by the arm 22.

A plurality of attachment holes 30 for mounting a casing 28 constituting the lock mechanism 24 are formed in a side surface of the body 16. The casing 28 is fixed in the attachment hole 30 through a fixing bolt 26. Further, plural positioning holes 34 are formed in the side surface of the body 16, into which positioning pins 32 are inserted for performing positioning when the casing 28 is attached (see FIG. 2). Further, the above-noted attachment holes 30 and positioning holes 34 may also be used in the event that other elements are attached to the clamp apparatus 10.

The cylinder section 18 includes a hollow cylinder tube 38 having a cylinder chamber 36 defined therein, and an end block 40 connected to one end of the cylinder tube 38 for closing the cylinder chamber 36. Moreover, through holes (not shown) are formed along the axial direction in the four corners of the cylinder tube 38 and the end block 40, and connecting bolts 41 are inserted through and tightened in the through holes, whereby the end block 40 and the cylinder tube 38 are connected integrally with respect to the body 16.

A pair of first fluid inlet/outlet ports 42*a*, 42*b*, through which a pressure fluid (for example, pressurized air) is introduced and discharged, is formed in a side surface of the end block 40. The first fluid inlet/outlet ports 42*a*, 42*b* communicate respectively through communication passages with the cylinder chamber 36. The first fluid inlet/outlet ports 42*a*, 42*b* are arranged facing each other on side surfaces of the end block 40, so as to be substantially symmetrical with respect to the axis of the end block 40.

Figure 4:
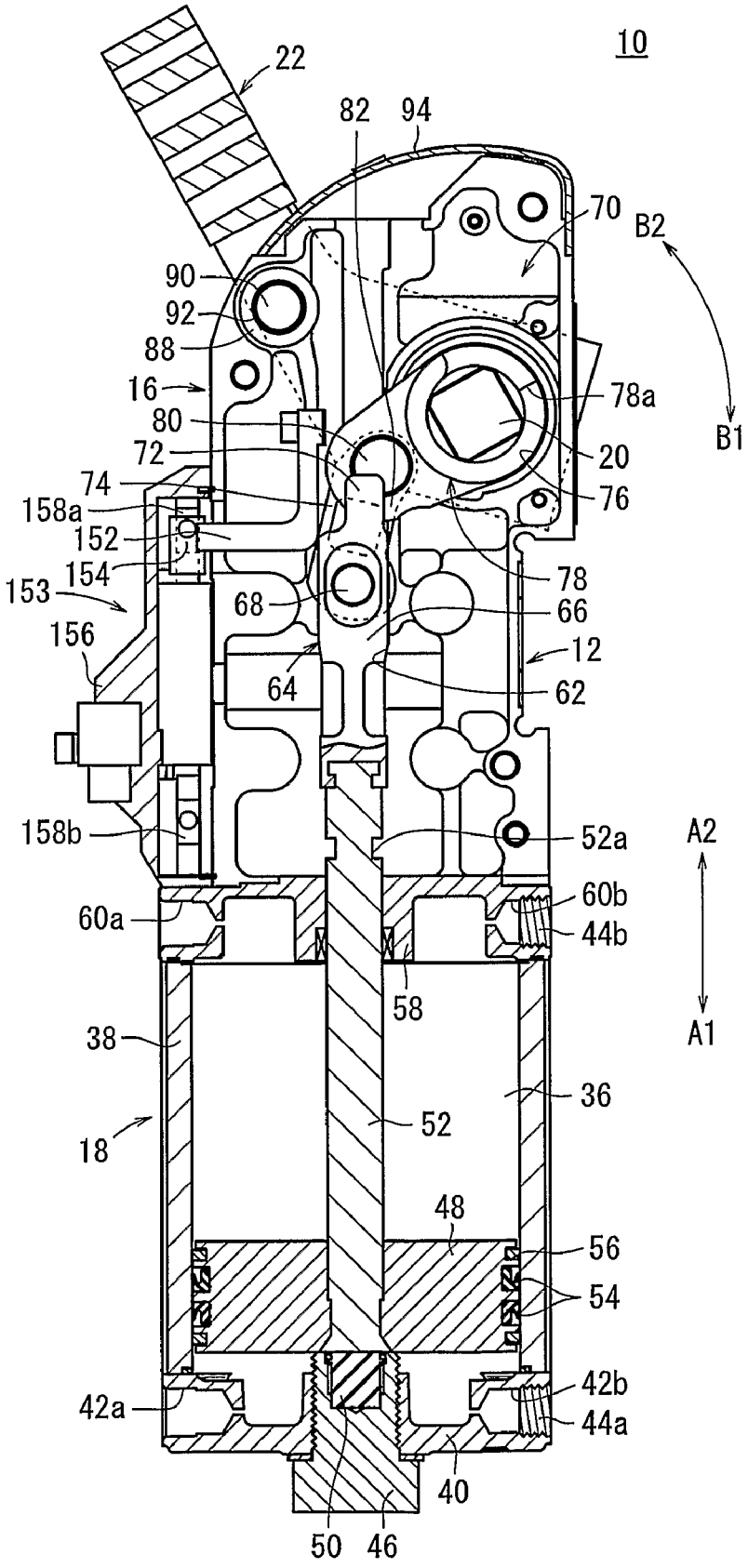
FIG. 4 is a vertical cross sectional view showing an unclamped state of the clamp apparatus of FIG. 1.

One from among the pair of first fluid inlet/outlet ports 42*a*, 42*b* is used selectively, while the other unused first fluid inlet/outlet port 42*b*, for example, is blocked by a plug 44*a* (see FIG. 4).

Further, a sealing bolt 46 is threaded substantially in the center of the end block 40 through a screw hole that penetrates in the axial direction. A damper member 50 formed from a rubber material, for example from urethane rubber or the like, is installed onto an end of the sealing bolt 46.

In the interior of the cylinder tube 38, a piston 48 is disposed displaceably along the cylinder chamber 36, one end of a piston rod 52 being connected to a center portion of the piston 48. Pairs of piston packings 54 and sealing rings 56 are installed respectively through an annular groove on an outer circumferential surface of the piston 48.

In this case, when the piston 48 is displaced in a direction away from the body 16 (in the direction of the arrow A1), by abutment of the piston 48 against a damper member 50 that is disposed in the sealing bolt 46, the displacement terminal end position (lower limit position) of the piston 48 is regulated, and further, shocks generated upon abutment of the piston 48 are absorbed by the damper member 50.

Further, a surrounding groove (groove) 52*a* that is recessed in an annular shape is formed at the other end side of the piston rod 52, which is connected to a knuckle block 66 (described later). A guide rod (connecting member) 138 that constitutes part of the lock mechanism 24 is engaged in the surrounding groove 52*a*.

The first casing 12 and the second casing 14 constituting the body 16 are formed with asymmetrical shapes, the first casing 12 and the second casing 14 being assembled together integrally. A projecting member 58 that projects in a substantially horizontal direction, and further which functions as a rod cover, is formed integrally on the lower end of the first casing 12.

Further, a pair of second fluid inlet/outlet ports 60*a*, 60*b*, through which a pressure fluid (for example, pressurized air) is introduced and discharged, is formed on the lower end of the first casing 12. The second fluid inlet/outlet ports 60*a*, 60*b* communicate with the cylinder chamber 36 through communication passages and are arranged facing toward each other so as to be substantially symmetrical with respect to the axis of the first casing 12. Moreover, similar to the first fluid inlet/outlet ports 42*a*, 42*b*, one from among the pair of second fluid inlet/outlet ports 60*a*, 60*b* is used selectively, while the other unused second fluid inlet/outlet port 60*b* is blocked by a plug 44*b*.

Furthermore, guide grooves 62 facing each other are formed along the axial direction respectively on inner wall surfaces of the first casing 12 and the second casing 14 (see FIG. 4). A knuckle joint 64 connected to the other end of the piston rod 52 is disposed slidably along the guide grooves 62. That is, the knuckle joint 64 is guided linearly along the guide grooves 62 inside the body 16.

The knuckle joint 64 is constructed from a knuckle block 66 having a forked portion divided into substantially parallel portions separated by a predetermined distance, and a knuckle pin 68 inserted through a hole formed in the forked portions, along with providing a toggle link mechanism 70 for converting linear motion of the piston rod 52 into rotational movement of the arm 22.

Further, a pair of release projections 72 is provided, each of which projects upwardly on the forked portions of the knuckle block 66. The release projections 72 project respectively from holes formed on upper portions of the first and second casings 12, 14 when a workpiece is being clamped by the arm 22. On the other hand, the other end of the piston rod 52 is threaded into and connected to a lower end of the knuckle block 66.

The toggle link mechanism 70 includes a link plate 74 connected between the forked portions of the knuckle joint 64 through the knuckle pin 68, and a support lever 78 supported axially and rotatably in openings 76 formed in the first and second casings 12, 14, respectively.

The link plate 74 is installed between the knuckle joint 64 and the support lever 78, and carries out a function to link the knuckle joint 64 with the support lever 78. A pair of holes, separated from each other by a predetermined distance, is formed on the link plate 74. The link plate 74 is connected to the other end of the piston rod 52 through the knuckle pin 68, which is axially supported by one of the holes and the knuckle joint 64, whereas the link plate 74 also is connected to the support lever 78 through a link pin 80 axially supported in the other hole thereof.

The support lever 78 includes a forked support portion 82 in which the link pin 80 is axially supported, and a pair of axial bearings 20, which project in directions substantially perpendicular to the axis of the piston rod 52 and are exposed outside of the body 16 through the openings 76. The arm 22, which clamps an unillustrated workpiece, is installed detachably to the axial bearing 20. Further, the support lever 78 is disposed so as to rotate integrally with the arm 22.

More specifically, linear movement of the piston rod 52 is transmitted to the support lever 78 through the knuckle joint 64 and the link plate 74, whereby the support lever 78 is rotationally displaced through a given angle, at a state in which the support lever 78 is supported in the openings 76 of the body 16. Owing thereto, the arm 22 installed on the support lever 78 is rotated.

On the other hand, plates 84 are installed onto side surfaces of the first casing 12 and the second casing 14, so as to face toward the openings 76, through which the axial bearings 20 of the support lever 78 are inserted. Through holes 86, through which the axial bearings 20 are inserted, open in the plates 84.

Furthermore, a guide roller 88 is disposed rotatably inside the first and second casings 12 and 14, into recesses on the upper side thereof, in the vicinity of the toggle link mechanism 70. The guide roller 88 is supported rotatably by a pin member 90, and plural needle bearings 92 are installed inside the guide roller 88 along the circumferential direction thereof. That is, the guide roller 88 is disposed so as to be rotated smoothly under a rolling action of the needle bearings 92. In addition, the guide roller 88 is rotationally displaced through contact with a curved surface of the link plate 74, upon rotational movement of the link plate 74 that makes up the toggle link mechanism 70.

Moreover, at the peak of the body 16, a top cover 94 is installed, which covers the release projections 72. The top cover 94 is formed from an elastic material, for example, such as rubber or the like. As for the release projections 72, the peak of the body 16, including the release projections 72 that project from the opening holes, is surrounded and covered completely by the top cover 94. In addition, when the release projections 72 are operated, the top cover 94 is hit from above by an unillustrated plastic hammer or the like, whereupon, by downward displacement of the release projections 72, the clamped state of the clamp apparatus 10 is released so that the unclamped state can be restored.

The lock mechanism 24 includes a housing 100 sealed by first and second cover plates 96, 98, a handle (operating element) 102 supported rotatably with respect to the housing 100, which can be gripped and operated by an operator, and a transmission section 104 arranged inside the housing 100, which transmits a drive force from the handle 102, through the toggle link mechanism 70, and to the arm 22.

The housing 100 has a hollowed formation, the first and second cover plates 96, 98, having substantially the same shape, and being installed on both end surfaces thereof through bolts 106. A box-shaped casing 28 is constructed from the first and second cover plates 96, 98 and the housing 100.

In the casing 28, the second cover plate 98 is installed so that it is formed on a side of the body 16 of the clamp apparatus 10. A handle hole 110 opens in a side surface of the body 16 that faces toward the casing 28. The handle hole 110 is formed with an elongate shape having a predetermined length along the axial direction of the body 16, and a dust seal 112 is mounted between the side surface of the body 16 and the second cover plate 98, facing the handle hole 110.

Figure 2:
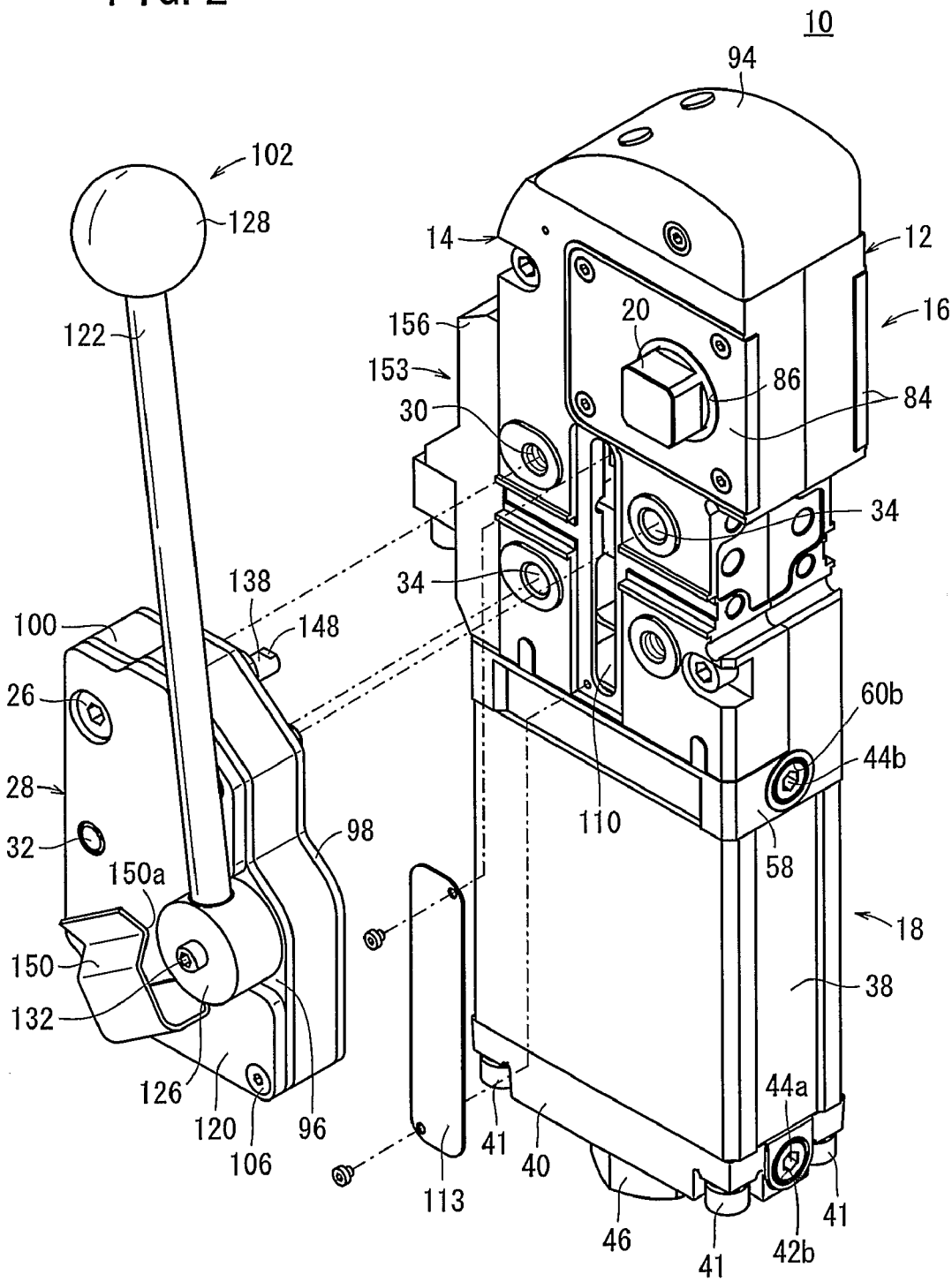
FIG. 2 is an exploded perspective view showing a state in which a lock mechanism is detached and separated from the clamp apparatus illustrated in FIG. 1.

In the event that the lock mechanism 24 is not provided, an elongate dust cover (cover) 113 is installed in the handle hole 110, which blocks the handle hole 110 such that communication between the interior of the body 16 and the outside is interrupted (see FIG. 2).

The dust seal 112 is formed from an elastic material, for example, such as rubber or the like, for maintaining an airtight condition between the body 16 and the casing 28. Further, an elongate hole 114 corresponding to the handle hole 110 is formed in the center of the dust seal 112, such that the elongate hole 114 and the handle hole 110 communicate with each other.

Further, the first and second cover plates 96, 98 are positioned facing each other while sandwiching the housing 100 therebetween. Guide holes 116*a*, 116*b*, which correspond to the handle hole 110, are formed respectively in central portions of the first and second cover plates 96, 98. Specifically, the guide holes 116*a*, 116*b* penetrate in a straight line with respect to the handle hole 110 and the elongate hole 114, and communicate mutually with each other.

Furthermore, pairs of pin holes 118 separated by a predetermined distance about the center of the guide holes 116*a*, 116*b* are formed respectively in the first and second cover plates 96, 98, and positioning pins 32 are inserted through the pin holes 118. The positioning pins 32, by being inserted through the positioning holes 34 of the body 16, position the casing 28 including the first and second cover plates 96, 98 thereof with respect to the side surface of the body 16 that constitutes the clamp apparatus 10.

Figure 3:
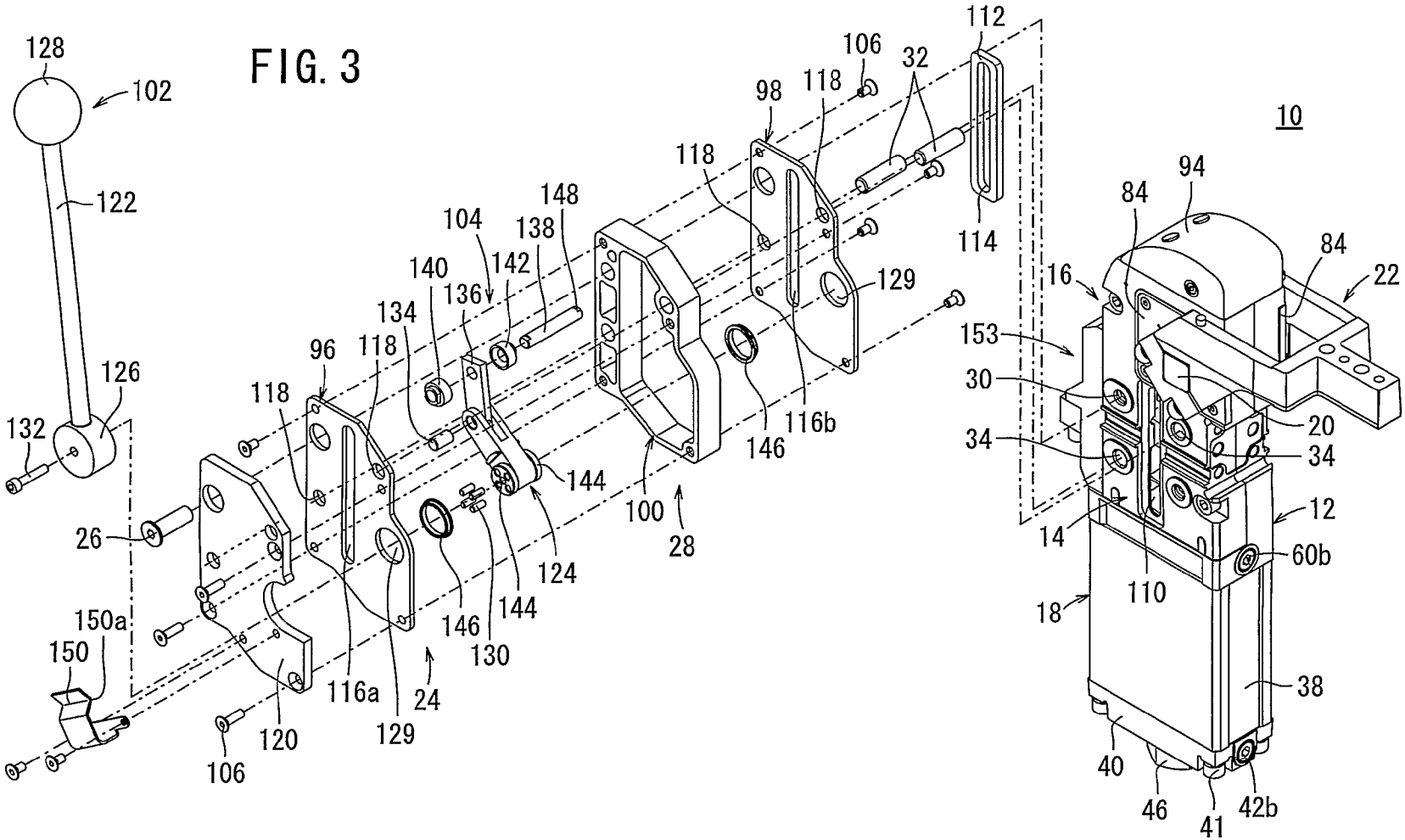
FIG. 3 is an exploded perspective view of the lock mechanism detached from the clamp apparatus shown in FIG. 2.
Figure 5:
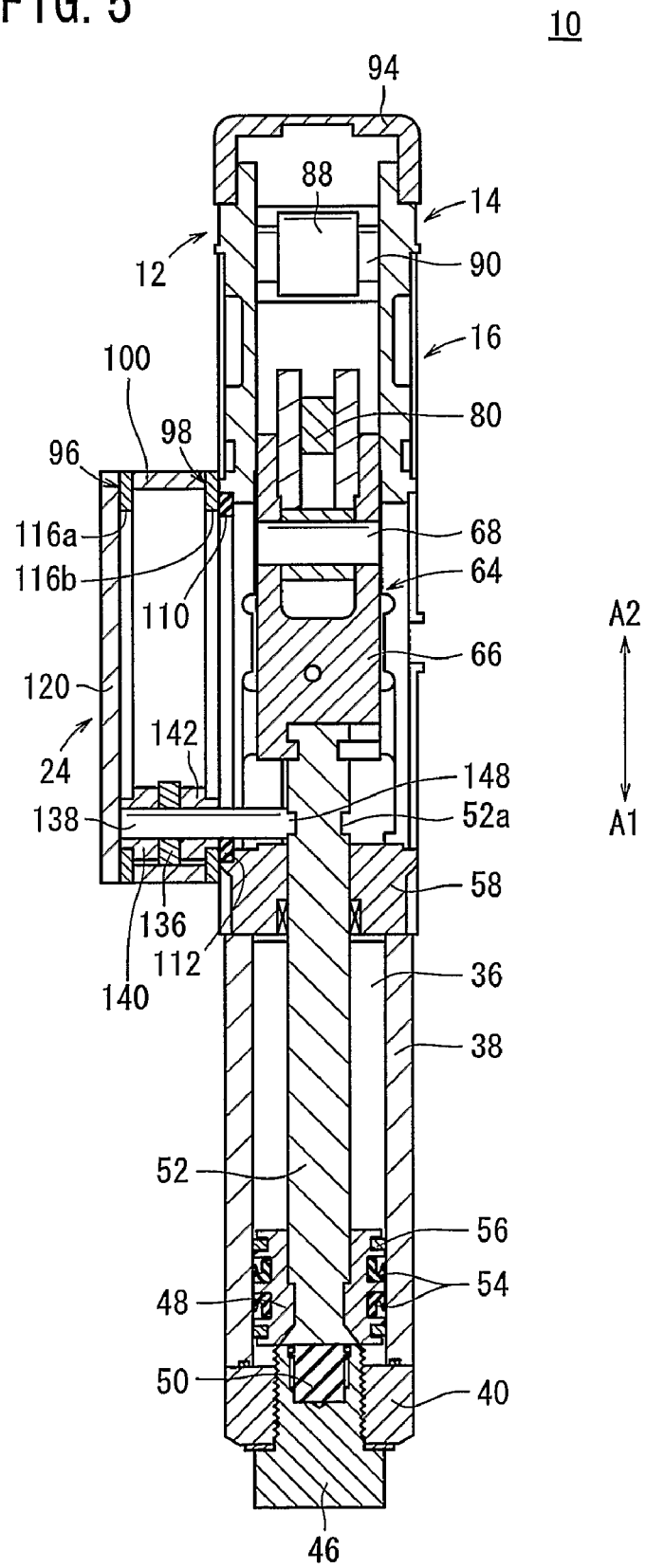
FIG. 5 is a cross sectional view taken along line V-V of FIG. 1.

Specifically, as shown in FIGS. 3 and 5, the guide holes 116*a*, 116*b* of the casing 28 are positioned so as to match the handle hole 110 of the body 16 and the elongate hole 114 of the dust seal 112.

In addition, after the casing 28 is positioned onto the side surface of the body 16 by the positioning pins 32, the fixing bolts 26, which are inserted through holes in the first and second cover plates 96, 98 and the housing 100, are threaded into the attachment holes 30 of the body 16. Accordingly, the casing 28 is fixed integrally with respect to the side surface of the body 16.

Further, a plate body 120, which is formed in substantially the same shape as the first cover plate 96, is mounted onto the first cover plate 96, whereby the guide hole 116*a* of the first cover plate 96 is covered and blocked by the plate body 120. Further, the plate body 120 is cut out so as to avoid a boss portion 126 of the handle 102 (see FIGS. 1 and 2).

The handle 102 includes a shaft 122 positioned on a side of the first cover plate 96 making up the casing 28 and formed with an elongate shape along its axial direction, a boss portion 126 disposed at one end of the shaft 122 and fixed to a handle lever (first linkage) 124 that constitutes the transmission section 104, and a spherical grip 128 provided at the other end of the shaft 122.

The boss portion 126 is positioned so as to face toward the support hole 129 of the first cover plate 96, with a plurality of pins 130 being installed in an end surface thereof. The pins 130 act to position the handle 102 including the boss portion 126 and the handle lever 124 by insertion thereof into the handle lever 124 (described later), as well as to regulate relative displacement thereof in the direction of rotation.

Further, a fixing bolt 132 is inserted through a substantially central part of the boss portion 126, whereby the handle 102 including the boss portion 126 thereof is connected to the transmission section 104 through the fixing bolt 132.

The transmission section 104 disposed inside the housing 100 includes a handle lever 124 to which the boss portion 126 of the handle 102 is connected, a rod plate (second linkage) 136 axially supported through a lever pin 134 on the handle lever 124, and a pair of first and second sliders 140, 142 installed on an end of the rod plate 136 through a guide rod 138.

Circular projections 144, which project from the sides of one end of the handle lever 124, are inserted into support holes 129 of the first and second cover plates 96, 98, and are rotatably supported therein through annular bushes 146. The bushes 146 are disposed respectively on sides of the first cover plate 96 and the second cover plate 98.

Further, the other end of the handle lever 124 is formed with a forked shape, one end of the rod plate 136 being inserted therein and axially supported rotatably by a lever pin 134 inserted through the other end of the handle lever 124. Specifically, the rod plate 136 is supported and capable of relative displacement through a given angle with respect to the handle lever 124 about a support point or fulcrum defined by the lever pin 134.

One end of the rod plate 136 is axially supported by the handle lever 124, whereas the guide rod 138 is inserted through the other end thereof, perpendicular to the longitudinal direction of the rod plate 136.

One end of the guide rod 138 is disposed on the side of the first cover plate 96. A first slider 140, having a cylindrical shape, is installed on the end of the guide rod 138, the first slider 140 engaging with the guide hole 116*a*. On the other hand, the other end of the guide rod 138 is arranged on the side of the second cover plate 98 and is inserted through a cylindrically shaped second slider 142, and further, is inserted through the handle hole 110 of the body 16 while passing through the guide hole 116*b* of the second cover plate 98. In this case, the guide rod 138 is arranged so as to be substantially perpendicular to the piston rod 52 disposed inside the body 16.

Figure 7:
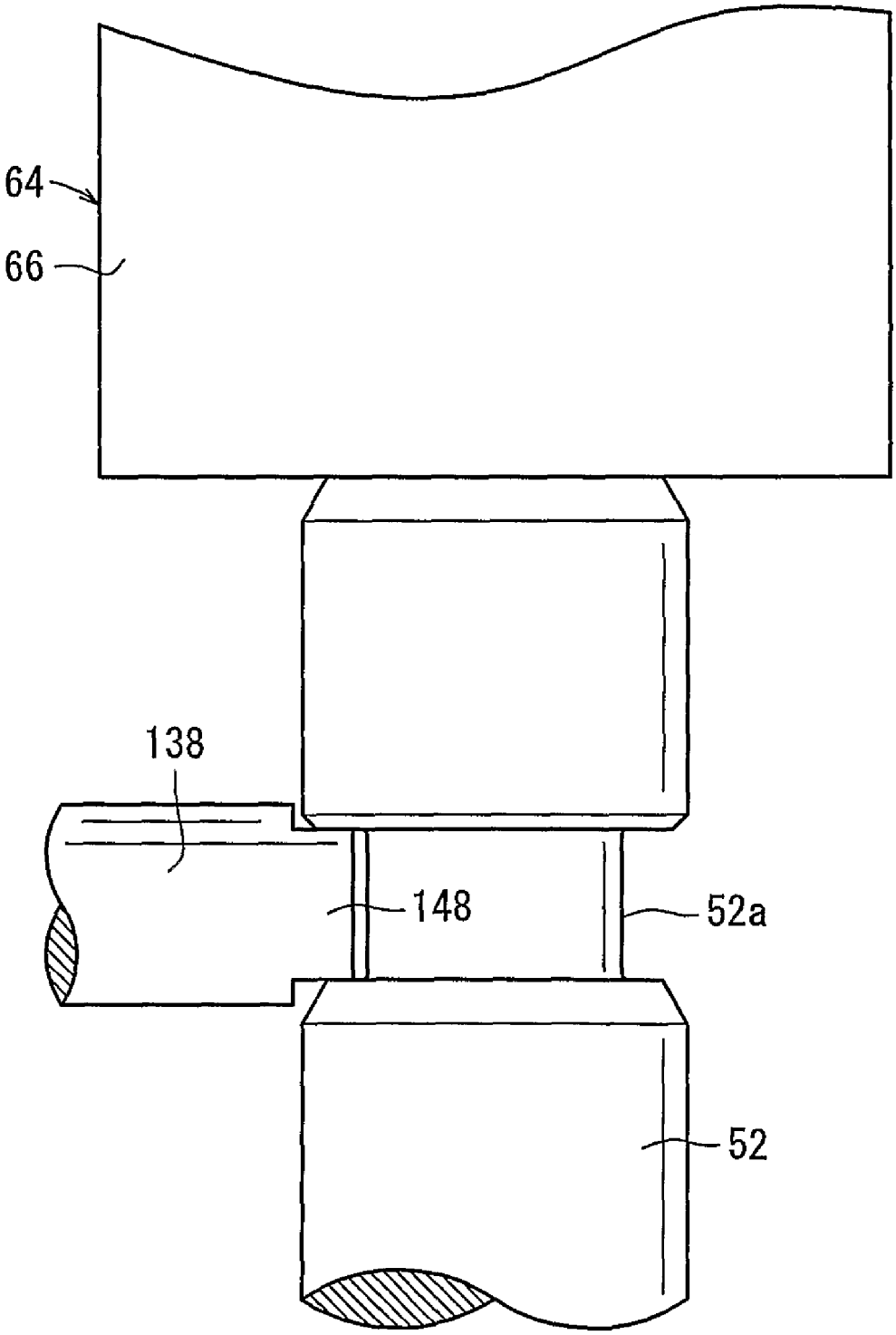
FIG. 7 is a magnified view showing a connected region between a piston rod and a guide rod in FIG. 6.

Further, a cutout portion 148, wherein the outer peripheral surface of the guide rod 138 is cut in a substantially flat surface shape, is formed at the other end of the guide rod 138. The cutout portion 148, which is formed in a narrowed shape having a substantially rectangular shape in cross section, engages within a surrounding groove 52*a* in the piston rod 52 (see FIG. 7). Specifically, by displacement of the piston rod 52 in the axial direction (the directions of arrows A1 and A2), the guide rod 138 is displaced integrally therewith.

In other words, the piston rod 52 is capable of being displaced by displacement of the guide rod 138. Stated in yet another way, the guide rod 138 is not displaced relative to the axial direction (the direction of arrows A1 and A2) of the piston rod 52 with respect to the piston rod 52, and is displaced integrally therewith at all times.

The first slider 140 engages within the guide hole 116*a* of the first cover plate 96 and is retained displaceably along the guide hole 116*a*. The guide hole 116*a* is covered and blocked by mounting of the plate body 120 thereon.

The second slider 142 engages in the guide hole 116*b* of the second cover plate 98 and is retained displaceably along the guide hole 116*b*. Specifically, the first and second sliders 140, 142 are guided in the axial direction along the guide holes 116*a*, 116*b* upon displacement of the guide rod 138. Stated otherwise, the first and second sliders 140, 142 function as regulating mechanisms, for restricting the displacement of the guide rod 138 to the extending direction of the guide holes 116*a*, 116*b*.

In greater detail, the handle lever 124 is rotated by operation and rotation of the handle 102, and along therewith, the guide rod 138 is displaced, through the rod plate 136, upwardly and downwardly (in the directions of arrows A1 and A2) along the guide holes 116*a*, 116*b*, while being guided by the sliders.

On the other hand, a stopper 150, which projects in a direction away from the first cover plate 96 and regulates rotational displacement of the handle 102, is installed on the plate body 120. The stopper 150 is formed with an L-shape in cross section which, after extending in a direction away from the plate body 120, is bent upwardly and extends substantially parallel to the plate body 120. More specifically, the stopper 150 is disposed so as to be separated a predetermined distance from the plate body 120.

In addition, after the handle 102 is rotated by an operator and accommodated within the stopper 150, the handle 102 is latched by a projection 150*a* that projects toward the side of the plate body 120, such that rotational displacement of the handle 102 is regulated.

Figure 8:
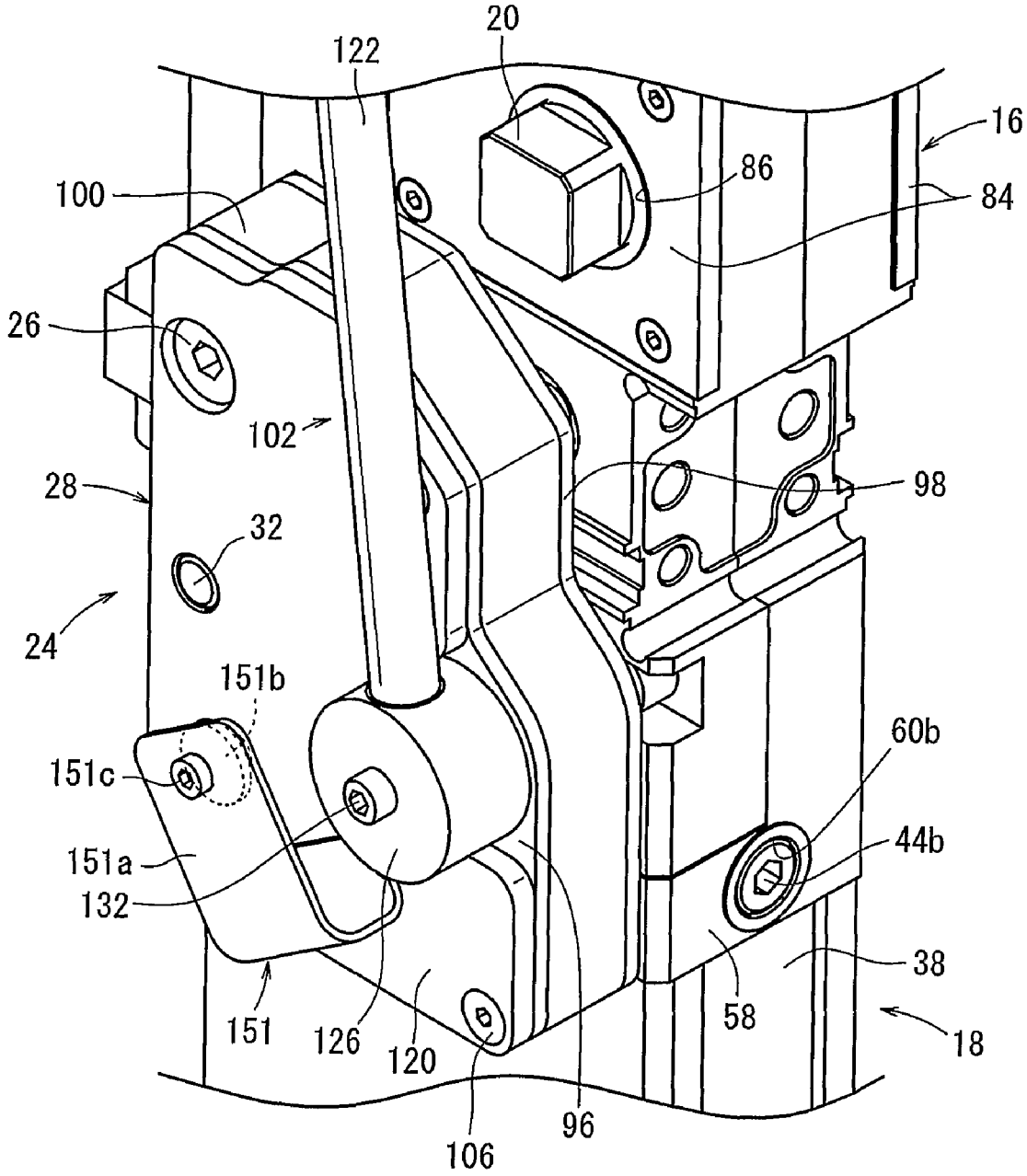
FIG. 8 is an enlarged perspective view showing the vicinity of the lock mechanism having a stopper installed thereon according to a modified example.
Figure 9:
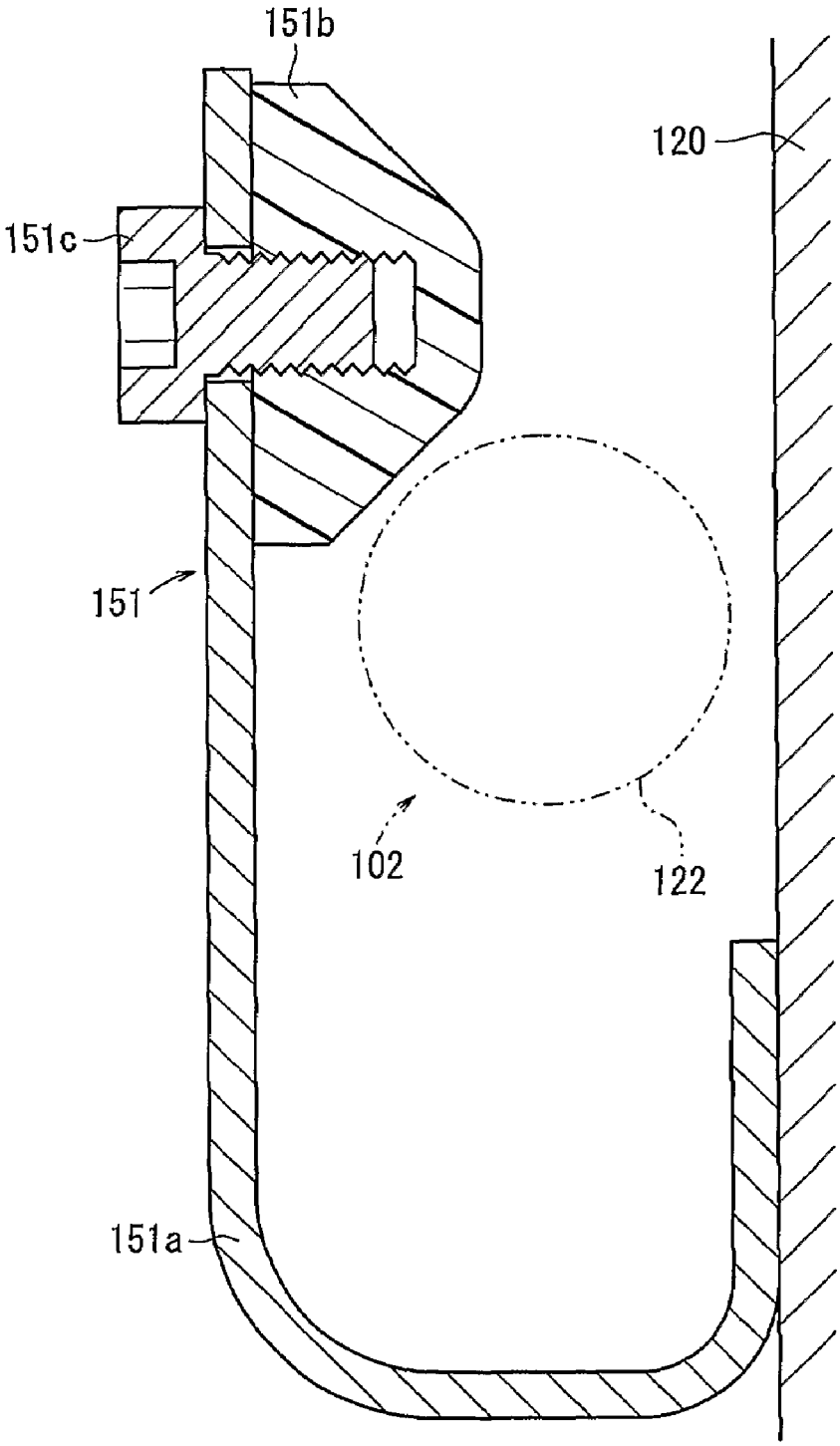
FIG. 9 is a cross sectional view showing a condition in which a handle is latched by the stopper of FIG. 8.

Further, the above-mentioned stopper 150 is not limited to being formed in an integral manner. For example, as shown in FIGS. 8 and 9, a two-piece stopper 151 may be provided, which is constructed from a stopper main body 151*a* formed by a bent plate, and a stopper block 151*b* mounted on a side of the plate body 120 of the stopper main body 151*a*.

The stopper main body 151*a* is bent upwardly and extends in a flat surface shape, wherein the stopper block 151*b* is fixed to an upper end of the stopper main body 151*a*. The stopper block 151*b* is formed, for example, from a resin material having a substantially triangular shape in cross section, which is mounted onto the inner wall surface of the stopper main body 151*a* through a bolt 151*c*, while projecting at a given height toward the side of the plate body 120. The stopper block 151*b* is not limited to being formed from a resin material, but may also be formed from an elastic material such as rubber or the like, or from a metallic material.

Additionally, when the handle 102 is rotated by the operator and accommodated within the stopper 151, the handle 102 first abuts against the stopper block 151*b* and passes beyond the stopper block 151*b*, and then the shaft 122 of the handle 102 abuts against the stopper block 151*b*. Accordingly, the handle 102 is engaged and stopped by the stopper block 151*b*, whereby further rotation of the handle 102 is regulated.

In the aforementioned stopper 151, since the stopper block 151*b* can easily be replaced in the event that the stopper block 151*b* becomes worn by repeated contact with the handle 102, maintenance operations thereon can be favorably carried out.

The detection mechanism 153 includes a detected body 154 installed onto the knuckle block 66 through a dog 152, along with a pair of sensors 158*a*, 158*b* arranged inside a holder 156 disposed on the side of the body 16, which detects the position of the detected body 154. In addition, a change in impedance, which occurs when the detected body 154 comes into the vicinity thereof, is detected by the sensors 158*a*, 158*b*, such that by detecting the position of the detected body 154, the rotational position of the arm 22 (i.e., the position at which the arm 22 is turned) can be detected.

The clamp apparatus 10 according to the embodiment of the present invention is constructed basically as described above. Next, operations and effects of the clamp apparatus 10 shall be explained.

First, the clamp apparatus 10 is fixed in a given position through an unillustrated fixing mechanism, and tubes or the like (not shown), which are connected to a pressure fluid supply source, are connected respectively to the first and second fluid inlet/outlet ports 42*a*, 60*a*. FIG. 1 shows the clamp apparatus 10 in a clamped state, whereas FIG. 4 shows the clamp apparatus 10 in an unclamped state. Hereinafter, the above-mentioned unclamped state shall be considered as the initial condition of the clamp apparatus 10.

Figure 10:
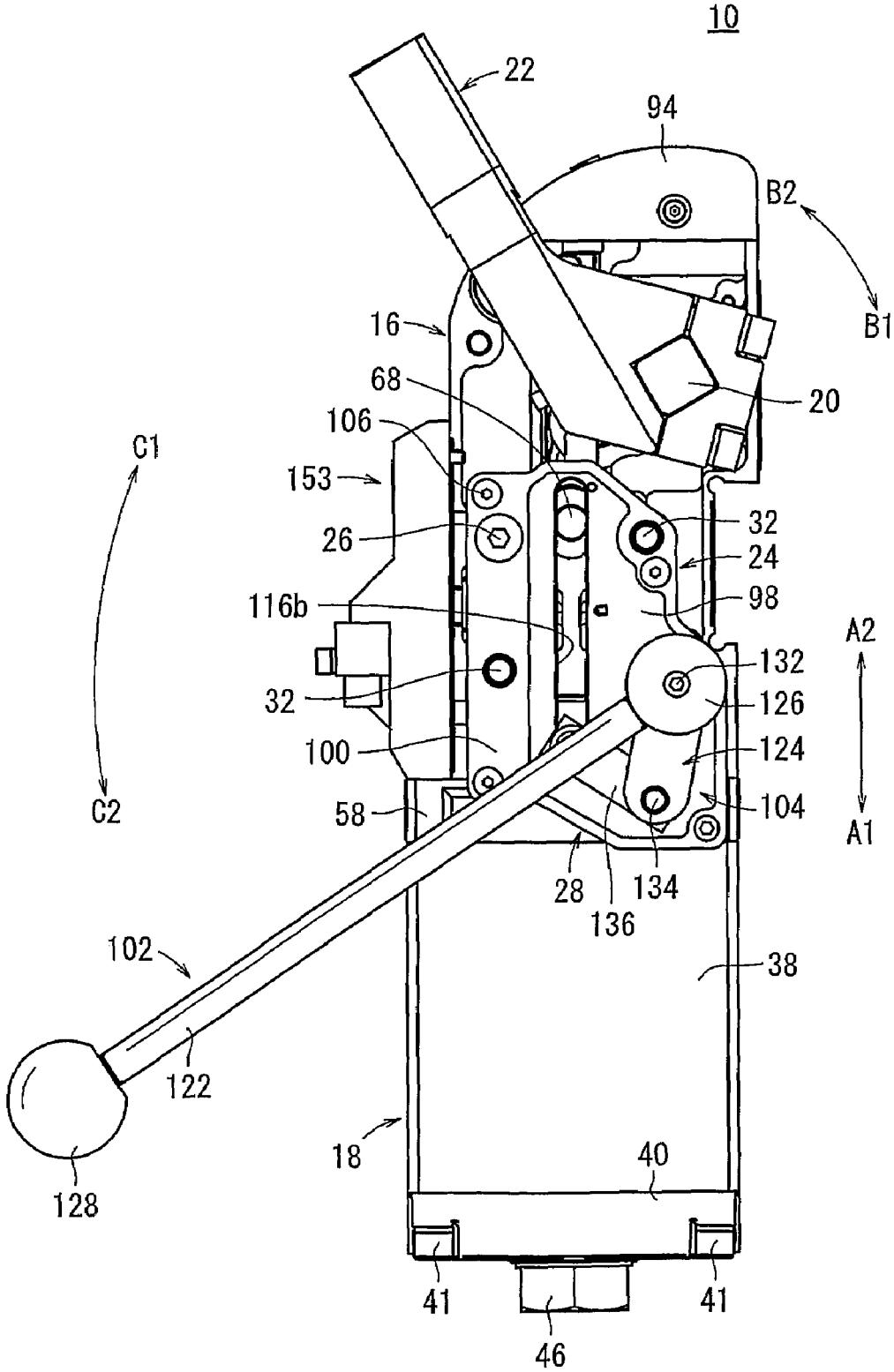
FIG. 10 is a partially omitted side plan view showing an unclamped state of the clamp apparatus illustrated in FIG. 4.

In the initial condition of the clamp apparatus 10 shown in FIG. 4 and FIG. 10, pressure fluid from an unillustrated pressure fluid supply source is supplied to the first inlet/outlet port 42*a*, and the pressure fluid is introduced into the cylinder chamber 36. Under an action of the pressure fluid that is introduced into the cylinder chamber 36, the piston 48 is pressed toward the body 16 (in the direction of the arrow A2) and the piston 48 is raised along the cylinder chamber 36. In addition, upon displacement of the piston 48 and the piston rod 52, the knuckle block 66 is slidably displaced while being guided by the guide grooves 62.

Linear movement of the piston 48 is transmitted to the toggle link mechanism 70 through the piston rod 52 and the knuckle joint 64, which is converted into rotary movement of the arm 22 under a rotating action of the support lever 78 that makes up the toggle link mechanism 70. Specifically, an upwardly directed pressing force (in the direction of the arrow A2) acts on the link plate 74 and the knuckle joint 64 connected to the piston rod 52, in accordance with the linear movement of the piston 48.

Additionally, the pressing force with respect to the link plate 74 causes the link plate 74 to be rotated through a given angle about the fulcrum defined by the knuckle pin 68, whereupon the support lever 78 rotates clockwise (in the direction of the arrow B1) as a result of its being linked to the link plate 74. Stated otherwise, the arm 22 is rotated through a predetermined angle about a fulcrum point defined by the axial bearings 20 of the support lever 78.

Figure 11:
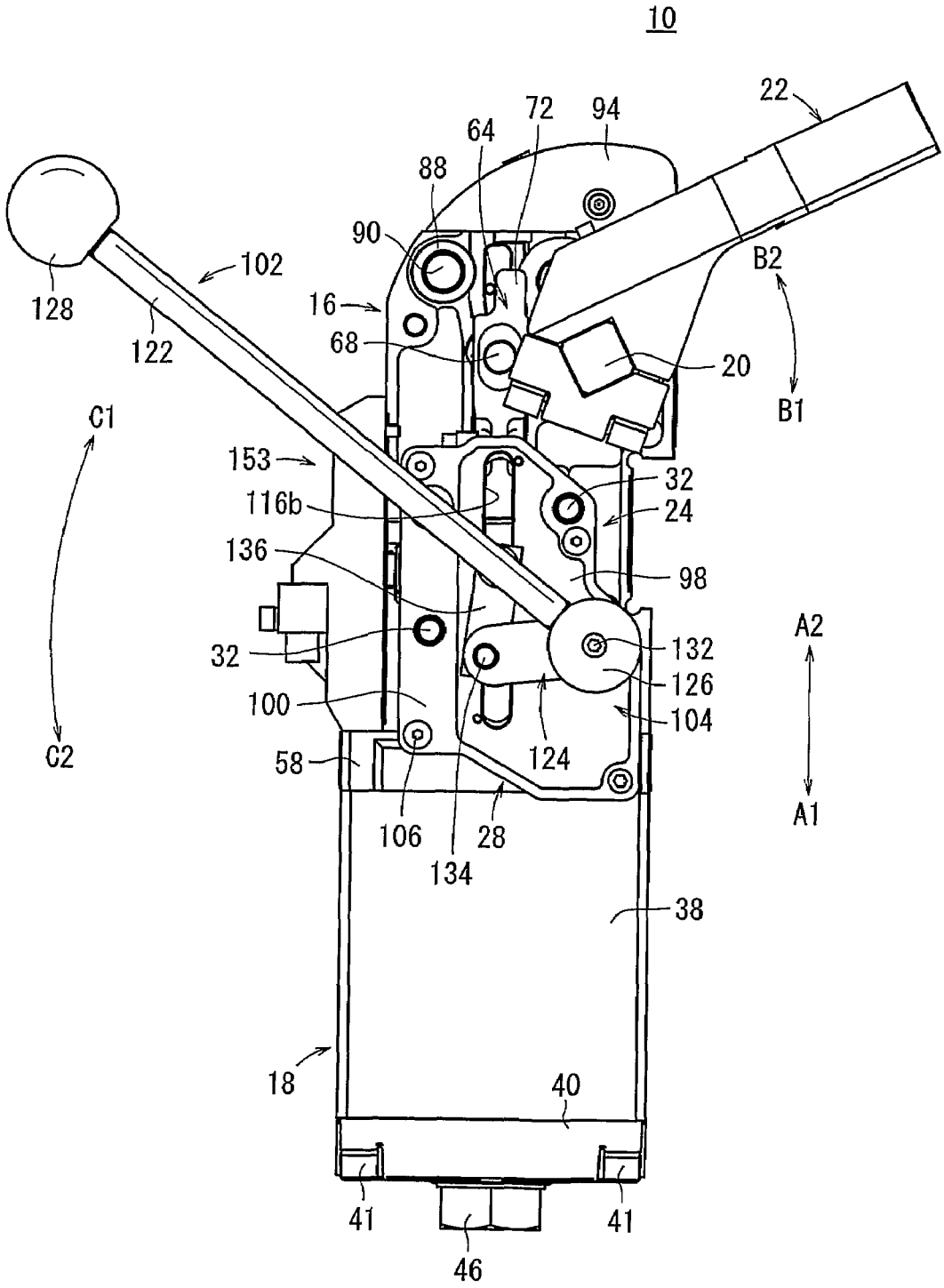
FIG. 11 is a partially omitted side plan view showing a state in which an arm of the clamp apparatus of FIG. 10 is turned at a given angle.

In this manner, when the arm 22 is rotated, the curved surface of the link plate 74 comes into contact with the guide roller 88, and while the contacted state with the curved surface is maintained, the guide roller 88 rotates counterclockwise about the pin member 90. In addition, the arm 22 is rotated in a direction (the direction of arrow B1) to approach the unillustrated workpiece (see FIG. 11), whereupon by abutment of the arcuate projections 78*a* of the support lever 78 against a plate (not shown) affixed to the body 16, rotational displacement of the arm 22 through the piston rod 52 and the toggle link mechanism 70 is stopped (see FIG. 12).

Figure 12:
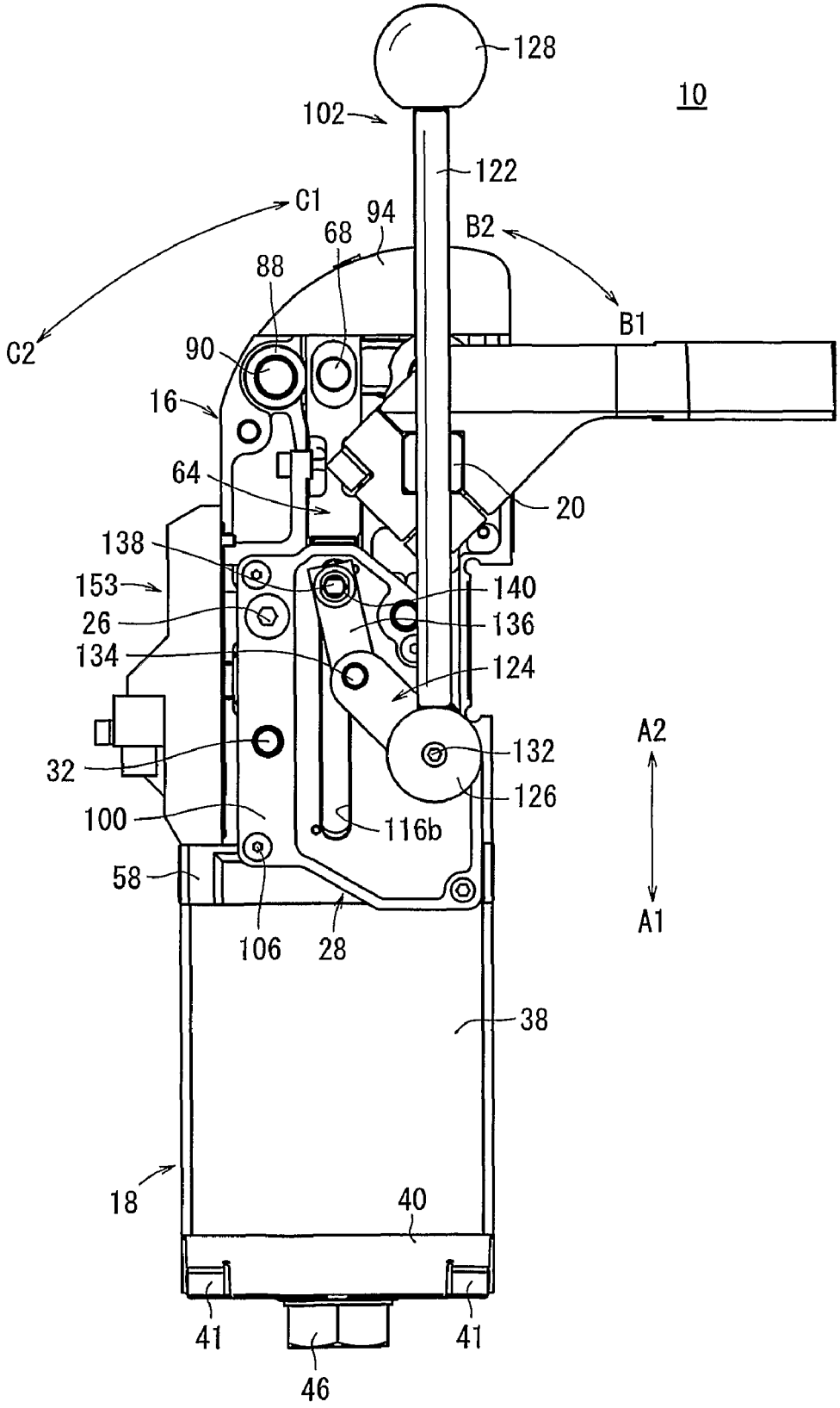
FIG. 12 is a partially omitted side plan view showing a clamped state of the clamp apparatus, in which the arm in FIG. 11 is turned even further.

As a result, as shown in FIG. 12, the clamp apparatus 10 acquires a clamped state in which the arm 22 is rotated clockwise (in the direction of the arrow B1) by a predetermined angle.

At this time, the detected body 154 constituting the detection mechanism 153 is displaced upwardly together with the knuckle block 66, and by detection of a change in impedance by one of the sensors 158*a* disposed inside the holder 156, it is confirmed that the arm 22 is in a clamped state.

In this case, the pair of release projections 72 formed on the upper portion of the knuckle block 66 acquire a state in which the release projections 72 project upwardly a given length through opening holes in the body 16. Accordingly, by displacement of the release projections 72 downwardly (in the direction of the arrow A1), for example, by an operator directly hitting the top cover 94 from above using an unillustrated plastic hammer or the like, the clamped state of the clamp apparatus 10 can be released and restored to an unclamped state.

Figure 6:
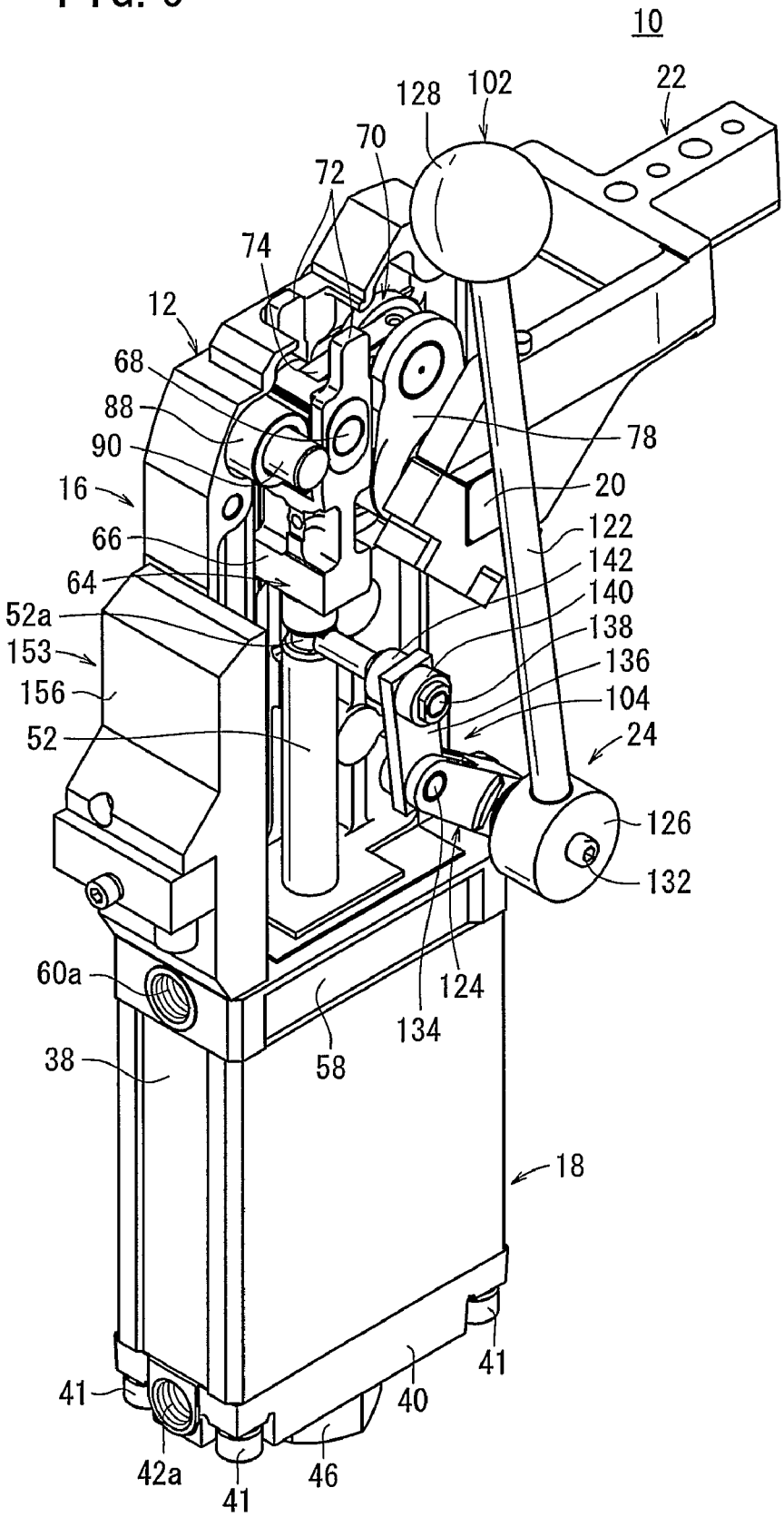
FIG. 6 is a perspective view as observed from a different direction, and showing a state in which a portion of a first casing is detached and a toggle link mechanism and the interior of the lock mechanism are exposed to the outside, in the clamp apparatus of FIG. 1.

On the other hand, in the clamped state shown in FIGS. 6 and 12, by supplying a pressure fluid to the second inlet/outlet port 60*a*, under a switching operation of an unillustrated directional control valve, the piston 48 is displaced in a direction (the direction of the arrow A1) to separate away from the body 16. In addition, by downward movement of the piston rod 52 together with the piston 48, the support lever 78 is rotated in an opposite direction (the direction of the arrow B2) through the link plate 74 that makes up the toggle link mechanism 70. Along therewith, the arm 22 is rotated in a direction away from the workpiece (not shown).

In addition, by abutment of the piston 48 against the damper member 50 of the sealing bolt 46, which is threaded into the end block 40, further displacement of the piston 48 is regulated, and rotary displacement of the arm 22 through the piston rod 52 and the toggle link mechanism 70 is stopped (see FIG. 10). As a result, the clamp apparatus 10, as shown in FIGS. 4 and 10, is placed in an unclamped state, in which the arm 22 is rotated counterclockwise (the direction of the arrow B2) by a predetermined angle.

Further, the detected body 154 is displaced together with the knuckle block 66 and is detected by the other downwardly disposed sensor 158*b*, whereby the fact that the arm 22 has acquired an unclamped state is detected by the detection mechanism 153.

Next, an explanation shall be made of a case in which the clamped state is switched by operating the arm 22 manually through the lock mechanism 24 in the aforementioned clamp apparatus 10. In the unclamped state shown in FIGS. 4 and 10, the handle 102 is rotated by a predetermined angle, whereby the shaft 122 is accommodated within the stopper 150.

At first, in the unclamped state, an operator clasps the grip 128 of the handle 102 and rotates the handle 102 clockwise (in the direction of the arrow C1) through a given angle about the boss portion 126. Owing thereto, the rod plate 136 is turned through the handle lever 124 and the guide rod 138 is displaced upwardly while being guided by the first and second sliders 140, 142. As a result, the piston rod 52 with which the guide rod 138 is engaged also is displaced upwardly, and the arm 22 is rotated through the toggle link mechanism 70, thus obtaining a state in which clamping is initiated (see FIG. 11).

In addition, by rotating the handle 102 further clockwise (in the direction of the arrow C1), the guide rod 138 is displaced further upwardly along the guide holes 116*a*, 116*b*. Along therewith, since the piston rod 52 and the piston 48 are displaced upwardly, the arm 22 is rotationally displaced even further, and a clamped state enabling clamping of the workpiece is obtained.

More specifically, by rotating the handle 102, the guide rod 138 is displaced upwardly along the guide holes 116*a*, 116*b* of the first and second cover plates 96, 98, through the link plate 74 and handle lever 124 that make up the transmission section 104, whereupon the piston rod 52, which is connected to the guide rod 138, can be displaced together therewith. Accordingly, the arm 22 can be rotationally displaced through the toggle link mechanism 70 by displacement of the piston rod 52, thus acquiring a locked state in which the workpiece is clamped.

On the other hand, in the locked state of the workpiece by the arm 22, by an operator clasping and turning the handle 102 counterclockwise (in the direction of the arrow C2), i.e., in a direction opposite to that described above, the guide rod 138 constituting the lock mechanism 24 is displaced downwardly along the guide holes 116*a*, 116*b* while being guided by the first and second sliders 140, 142, and together therewith, the piston rod 52 also is displaced downward. As a result, the arm 22 is rotationally displaced counterclockwise (in the direction of the arrow B2) through the toggle link mechanism 70, thereby releasing the locked state of the workpiece by the arm 22.

In the foregoing manner, with the present embodiment, the lock mechanism 24 is disposed with respect to a side surface of the body 16 constituting the clamp apparatus 10. By an operator operating and turning the handle 102 of the lock mechanism 24, the guide rod 138 can be displaced through the transmission section 104 connected to the handle 102, along the guide holes 116*a*, 116*b* of the casing 28.

Accordingly, the piston rod 52, which is connected to the guide rod 138, can be displaced along the axial direction (the direction of arrows A1 and A2), and under a displacement action of the piston rod 52, the arm 22 is rotatably displaced through the toggle link mechanism 70, such that clamped and unclamped states of the arm 22 with respect to the workpiece can easily be changed manually.

Further, the lock mechanism 24 is disposed detachably with respect to a side surface of the body 16, and can easily be detached from the body 16 simply by unscrewing and removing the fixing bolts 26 inserted through the casing 28. On the other hand, after the casing 28 has been positioned with respect to the body 16 by the positioning pins 32, the casing 28 can be fixed easily by threading the fixing bolts 26 into the attachment holes 30.

In this manner, because the lock mechanism 24, which enables a clamped state by the arm 22 to be switched manually, can easily be mounted and detached with respect to an individual clamp apparatus 10, an operator can decide whether or not the lock mechanism 24 is required and selectively make use thereof depending on the use environment of the clamp apparatus 10. As a result, a hand-driven clamp apparatus that enables the arm 22 to be rotated manually does not have to be prepared separately from the clamp apparatus 10 which is driven under the supply of a pressure fluid, and thus equipment costs therefor can be reduced.

Furthermore, when the lock mechanism 24 is detached and separated from the body 16 constituting the clamp apparatus 10, the dust cover 113 is installed into the handle hole 110, which opens on the side surface of the body 16, thereby blocking the handle hole 110. Accordingly, the interior of the body 16 can be tightly closed, and an airtight condition can be assured.

The clamp apparatus according to the present invention is not limited to the above-described embodiment, and various other structures may be adopted as a matter of course, which do not deviate from the essential nature and gist of the present invention.

The invention claimed is:

1. A clamp apparatus, in which linear motion of a cylinder is converted to rotary motion by a toggle link mechanism and a workpiece is clamped by a clamp arm, comprising:

a main body;

a cylinder connected to said main body and having a piston that is displaced in an axial direction under a pressing action of a pressure fluid;

a switching mechanism, which is disposed detachably with respect to said main body, having an operating element operable by an operator, and a transmission section for transmitting a driving force applied by said operating element to said cylinder, said switching mechanism displacing said piston in the axial direction by operation of said operating element through said transmission section to switch between clamped and unclamped states of said workpiece, wherein said transmission section comprises a first linkage connected to said operating element, which is rotationally displaceable together with said operating element, a second linkage axially supported rotatably with respect to said first linkage, and a connecting member retained on an end of said second linkage and being displaced substantially in parallel with a displacement direction of said piston.

2. The clamp apparatus according to claim 1, wherein said connecting member extends in a direction substantially perpendicular to the displacement direction of said piston and is connected to a piston rod that is attached to said piston.

3. The clamp apparatus according to claim 2, wherein said piston rod is formed with a groove on an outer circumferential surface thereof facing said connecting member, an end of said connecting member being inserted into said groove.

4. The clamp apparatus according to claim 1, wherein said switching mechanism includes a casing, said transmission section being accommodated inside of said casing, said operating element being disposed on the exterior of said casing, said switching mechanism being installed on said main body through said casing.

5. The clamp apparatus according to claim 3, said main body including a hole on a side surface thereof, said connecting member constituting said transmission section being inserted in said hole, and wherein said transmission section and said piston rod are connected to one another through said hole.

6. The clamp apparatus according to claim 5, wherein when said switching mechanism is removed, a cover is installed in said hole for blocking said main body.

7. The clamp apparatus according to claim 1, wherein a stopper is provided on said switching mechanism, which is capable of regulating rotational displacement of said operating element.

8. The clamp apparatus according to claim 7, wherein said stopper is formed with an L-shaped cross section separated a predetermined distance with respect to said casing, said operating element being accommodated between said stopper and said casing.

* * * * *